United States Patent [19]

Hubble

[11] Patent Number: 4,682,451

[45] Date of Patent: Jul. 28, 1987

[54] PROTECTIVE COVER FOR WINDOW SILLS

[75] Inventor: Terence H. Hubble, New Malden, United Kingdom

[73] Assignee: P & H Enterprises Limited (Musical Products), New Malden, United Kingdom

[21] Appl. No.: 839,623

[22] Filed: Mar. 14, 1986

[30] Foreign Application Priority Data

Mar. 18, 1985 [GB] United Kingdom ..... 8506936

[51] Int. Cl.[4] ..... E06B 1/70

[52] U.S. Cl. ..... 52/97; 52/201; 52/217; 52/726; 52/728; 52/741

[58] Field of Search ..... 52/211, 208, 201, 97, 52/204, 212, 727, 235, 58, 60, 300, 96, 728, 741; 49/467, 468, 505

[56] References Cited

U.S. PATENT DOCUMENTS 4,492,062 1/1985 Levenez ..... 52/211 X

FOREIGN PATENT DOCUMENTS

| | | | |
|---|---|---|---|
| 2011487 | 9/1971 | Fed. Rep. of Germany | 52/235 |
| 2416390 | 11/1974 | Fed. Rep. of Germany | 52/211 |
| 2623781 | 12/1977 | Fed. Rep. of Germany | 52/211 |
| 380341 | 9/1964 | Switzerland | 52/235 |
| 2087462 | 5/1982 | United Kingdom | 52/204 |
| 739399 | 10/1985 | United Kingdom . | |

*Primary Examiner*—John E. Murtagh

*Attorney, Agent, or Firm*—Cushman, Darby & Cushman

[57] ABSTRACT

A protective cover for window sills comprises an elongate keeper strip (6), pinned securely to an upper surface of the sill adjacent a window frame (4); an elongate anchor strip (8) pinned to an under surface of the sill adjacent the subjacent brickwork (3); and an elongate, U-shaped cover member (7) having upper, front and lower walls shaped to embrace the exposed portion of the sill. Free edge portions of the cover member (7) are formed with detents (*7d*) and are insertable with a push fit into corresponding recesses in the keeper strip and anchor strip.

17 Claims, 6 Drawing Figures

PROTECTIVE COVER FOR WINDOW SILLS

This invention relates to a cover, for exterior window sills, whose primary purpose is to provide protection against ingress of moisture and deterioration of the sill from exposure to the sun, but which may additionally serve to improve the appearance of a sill which has deteriorated or as a decoration.

It is known to provide multi-part protective covers for window sills having a sheet material cover member to embrace the sill, and means for securing the cover member in position on the sill.

According to the present invention a protective cover for a window sill comprises: an elongate keeper strip member fixedly mountable along and on or closely adjacent to an upper surface of the sill where that surface meets a superposed structural member; an elongate anchor strip member fixedly mountable against or closely adjacent to an undersurface of the sill where that surface meets a subjacent structure; an elongate cover member having upper, front, and lower walls shaped to embrace the exposed portion of the sill, and means for maintaining free edge portions of the upper and lower walls of the cover member in engagement with the keeper strip member and the anchor strip member respectively.

According to a further aspect, the invention provides a method of applying a protective cover to a window sill, comprising: securing an elongate keeper strip member along and on, or closely adjacent to, an upper surface of the sill where that surface meets a superposed structural member; securing an elongate anchor strip member against or closely adjacent to an under surface of the sill where that surface meets a subjacent structure; providing an elongate cover member having upper, front and lower walls shaped to embrace the exposed portion of the sill; and fitting the cover member over the sill by permanently engaging free edge portions of the upper and lower walls with the corresponding keeper strip member and anchor strip member.

Preferably, the keeper strip member and the anchor strip member each include along the whole of their length a recess which, when the strip is in use, faces forwardly of the sill and receives the corresponding free edge portion of the cover member.

Preferably, the said free edge portions of the cover member are formed with detent means which, in use, enhance the grip exerted on the free edge portions by the corresponding strips.

The invention is capable of providing the advantages inter alia of:

(i) ease of application to an existing sill, on site, in water-tight manner;

(ii) ease of fitting into position;

(iii) ease of adaptation to sills of different frontal extent;

(iv) ease of adaptation to angled sills, such as in bay windows;

(v) capability of manufacture of a large proportion of its components by extrusion, particularly of plastics material.

By way of example the detent means may be one or more ribs, tenons or serrations extending preferably unbroken along the length of the free edge portion.

In an advantageous construction, the detent means are provided over a relatively large proportion of the back-to-front dimension of the upper and lower walls of the cover member, so that those walls may be cut down to enable a single manufactured size of cover member to be fitted to sills having widely different extents of projection from the building structure in which they are incorporated.

The keeper strip may be provided with an undercut, e.g. inclined, face for presentation towards the window frame so as to provide a nose which can readily be pressed into watertight engagement with the frame.

The recess of the keeper strip is advantageously defined between upper and lower lips which reduce in cross-section forwardly, so as to be more flexible and so as to merge smoothly to the surface of the upper wall of the cover member.

The anchor strip may be in the form of a hollow tubular box section of which the front-facing wall is indented to provide upper and lower wall portions together bounding the forwardly-facing recess.

The keeper strip, the anchor strip, and the cover member are preferably all made of constant transverse cross-section, such that they may be produced by extrusion without requiring subsequent working operations.

The protective cover may further comprise an end cap for engagement onto the exposed end of the cover member. In a preferred construction, the end cap has a main body forming a closure for the cross-section of the cover member, and flange means projecting from the main body and bounding a recess into which end-edge portions of the cover member may be force-fitted. Advantageously an outer flange is of greater extent, in the longitudinal direction of the cover member, than an inner flange.

The protective cover may further comprise a joint member having upper, front and lower limbs at each side of which are provided respective recesses into which may be force-fitted the free end-edges of two adjacent cover members disposed end to end. By way of example, the respective recesses may be defined between inner and outer flanges of the joint member. Where the protective cover is to be applied to a compound still having a number of sill elements disposed end to end at an angle, e.g. in a bay window construction, the joint member may be in the form of a mitre joint member in which the recesses of the front limb of the joint member lie at an angle corresponding to the mitre angle at which the adjacent ends of the cover members have been cut.

Advantageously, when the protective cover is in use a packing, preferably mastic, is provided between the lower surface of the upper wall of the cover member, and the upper surface of the sill. A packing and/or seal is advantageously provided between the anchor strip and the structure on which it is mounted.

The keeper and anchor strips, the cover member and preferably also the end cap and joint or mitre joint members are preferably made of a hard but flexible mouldable material, e.g. a plastics material such as PVC.

In order that the nature of the invention may be readily ascertained, two embodiments of the invention are hereinafter particularly described with reference to the figures of the accompanying drawing, wherein.

Figure 1:
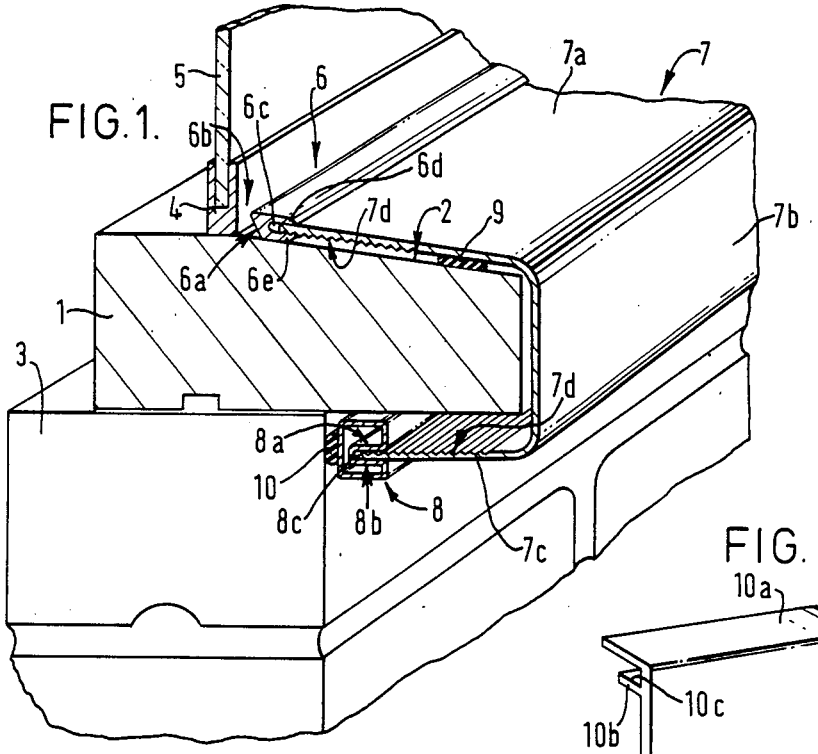
FIG. 1 is a perspective elevation of a first protective cover embodying the invention and fitted to a typical sill, and with an end cap omitted so as to reveal detail.

Referring to FIG. 1, the protective cover is shown fitted to a typical sill 1 having an inclined front upper surface 2. The sill is supported on brickwork 3 and itself supports a frame 4 for a window pane 5.

The protective cover includes a keeper strip 6, a cover member 7, and an anchor strip 8.

In use, the keeper strip 6 is secured on the upper face of the sill 1, firmly abutting the front face of the window frame 4 to prevent ingress of moisture at that point. The strip 6 is secured in any convenient manner, e.g. as by nailing, pinning, adhesive, mastic or the like. The strip 6 has an inclined rear face 6*a* defining a nose 6*b* which can more readily form a watertight seal against the frame 4.

At its front part, the strip 6 includes a recess 6*c* which extends the entire length of the strip and which is defined between two lips 6*d* and 6*e* which both taper outwardly in section so as to be relatively pliable. The unconstrained width of the recess 6*c* is preferably made slightly less than the wall thickness of the cover member to be introduced therein, so that a tight push fit is obtained between the lips 6*d* and 6*e*.

The cover member 7 is substantially U-shaped in cross-section and comprises a plane upper wall 7*a*, a plane front vertical wall 7*b*, and a plane lower wall 7*c*, which merge into each other by suitable radiused corners.

On its inner face, the upper wall 7*a* is provided with a plurality of parallel detents 7*d* which extend along the entire length of the cover member. When the edge portion of the plane upper wall 7*a* is forced, in a direction substantially perpendicular to the front wall 7*b*, into the recess 6*c* of the keeper strip 6, the presence of the first one or two of the detents 7*d* engaging with the lower lip 6*e* causes a very firm engagement of the wall 7*a* with the strip 6 so that the two members will not tend to become disengaged unless forcibly removed. The inner surface of the lower lip 6*e* may be provided with corresponding detents along its entire length, so that the two series of detents may interengage for an even more positive locking of the cover member wall in the strip 6.

It is intended that the front-to-back dimension of the cover member 7 may be varied, to suit different front-to-back widths of sill, and accordingly the detents 7*d* are provided over a considerable extent of the upper wall 7*a*, so that if the wall 7*a* has to be cut back somewhat to make it fit onto a sill there will always be a detent 7*d*, or several of them, available to engage into the strip 6.

The upper wall 7*a* of the cover member is spaced above the sill 1 by the thickness of the lower lip 6*e* of the strip 6. To support the cover member, relative to the sill, a packing 9 is interposed between the underface of the top wall 7*a* and the upper face of the sill 1. This packing may conveniently consist of a mastic, or of the proprietory material known as SCOTCHSEAL strip, for sound insulation and stability.

In use, the front-to-back dimension of the top wall 7*a* is selected such that the front wall 7*b* is just spaced from the front wall of the sill 1.

The anchor strip 8 is attached in any convenient manner to the front face of the brickwork 3, at a spacing below the sill 1. Preferably a waterproof packing, e.g. a SCOTCHSEAL strip 10, is interposed between the anchor strip 8 and the brickwork 3. The anchor strip 8 is a hollow box section which includes an upper wall 8*a* and a lower wall 8*b* bounding a recess 8*c*. Again for the purpose of enhancing the grip exerted between the anchor strip 8 and the wall 7*c* the latter is provided on its inner face with a series of parallel detents 7*d*. Again, the width of the recess 8*c* is made such that the wall 7*c* is a push-fit into the recess, and again the detents 7*d* are provided over a wide zone of the wall 7*c* so that the latter may be cut back, if necessary, and there will still be at least one detent 7*d* available to engage into the recess 8*c*.

The space between the protective cover and the sill, bounded by the packing 9 on the upper face of the sill and the anchor strip 8, constitutes an air gap allowing free circulation of air therein.

It will be noted that each of the items: keeper strip 6, cover member 7, and anchor strip 8 is of constant cross-section throughout its length, so that those items can accordingly be manufactured by extrusion and simply cut to length. Advantageously they are made of a hard but pliable plastics material such as PVC, modified if necessary to eliminate or reduce degradation by sunlight, atmospheric pollutants, and changes of temperature.

Figure 2:
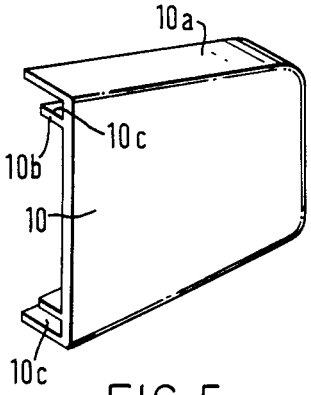
FIG. 2 is a perspective elevation of an end cap to form part of the protective cover.
Figure 4:
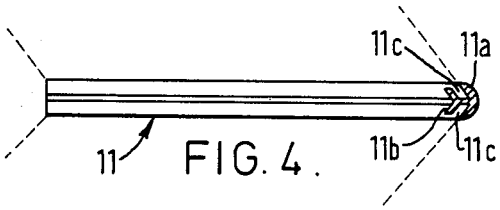
FIG. 4 is a horizontal section taken on the line IV—IV of FIG. 3.
Figure 3:
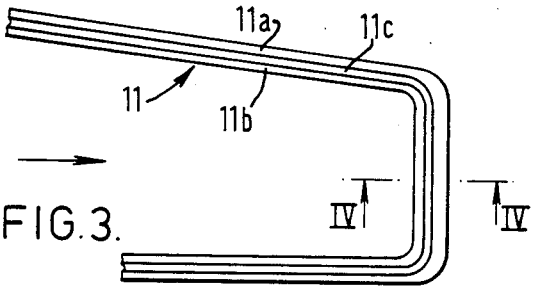
FIG. 3 is a side elevation of a mitre joint member for use in applying the protective cover to bay window sills.
Figure 5:
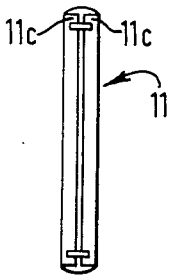
FIG. 5 is a rear end elevation of the mitre joint member viewed in the direction of the arrow in FIG. 3.

To terminate each end of the protective cover there is provided an end cap as seen in FIG. 2. This has a main body 10 from which projects an outer flange 10*a* and an inner flange 10*b* of lesser extent, the two flanges defining between them a recess 10*c* which is a tight push-fit onto the exposed end of the cover member 7.

Where the sill is on a bay window and thus consists of a series of straight sill elements positioned end to end and each at a small angle to the next, there is used a corresponding number of the cover members 7 each cut to the appropriate length of the front face of the sill 1, but cut back at each end to form a mitre. Where the mitred edges of two adjacent cover members 7 meet, there is positioned a mitre joint member 11 as seen in FIGS. 3, 4, and 5. This has an outer flange 11*a* and an inner flange 11*b* which together bound respective opposite recesses 11*c*. The respective recesses 11*c* each receive the free end edge portion of a respective cover portion 7. The upper limb and the lower limb of the joint member 11 have the recesses 11*c* extending in the same plane, whereas the front vertical limb of the joint member has the recesses 7*c* aligned at an included angle, as will be apparent from FIG. 4, to accommodate the angle at which the respective front walls 7*b* of the adjacent cover members meet. To permit engagement of the joint members 11 onto front walls 7*b* which meet at angles varied over a wide range, the joint members could be manufactured in a number of kinds in which the angle is varied at intervals over a range suitably to fit any desired angle. The joint members 11 are likewise preferably made of hard but pliable plastics material, so that some degree of accommodation of angle is available. The width of the recesses 11*c* is advantageously made such that the walls of the cover members 7 are a tight push fit therein.

It will be appreciated that to permit the free rear end face of the upper and lower limbs of the joint members 11 to butt up against the window frame 4, and the brickwork 3, respectively, the keeper strip 6 and the anchor strip 8 could be cut slightly shorter than the cover member 7 at its rear edges.

Figure 6:
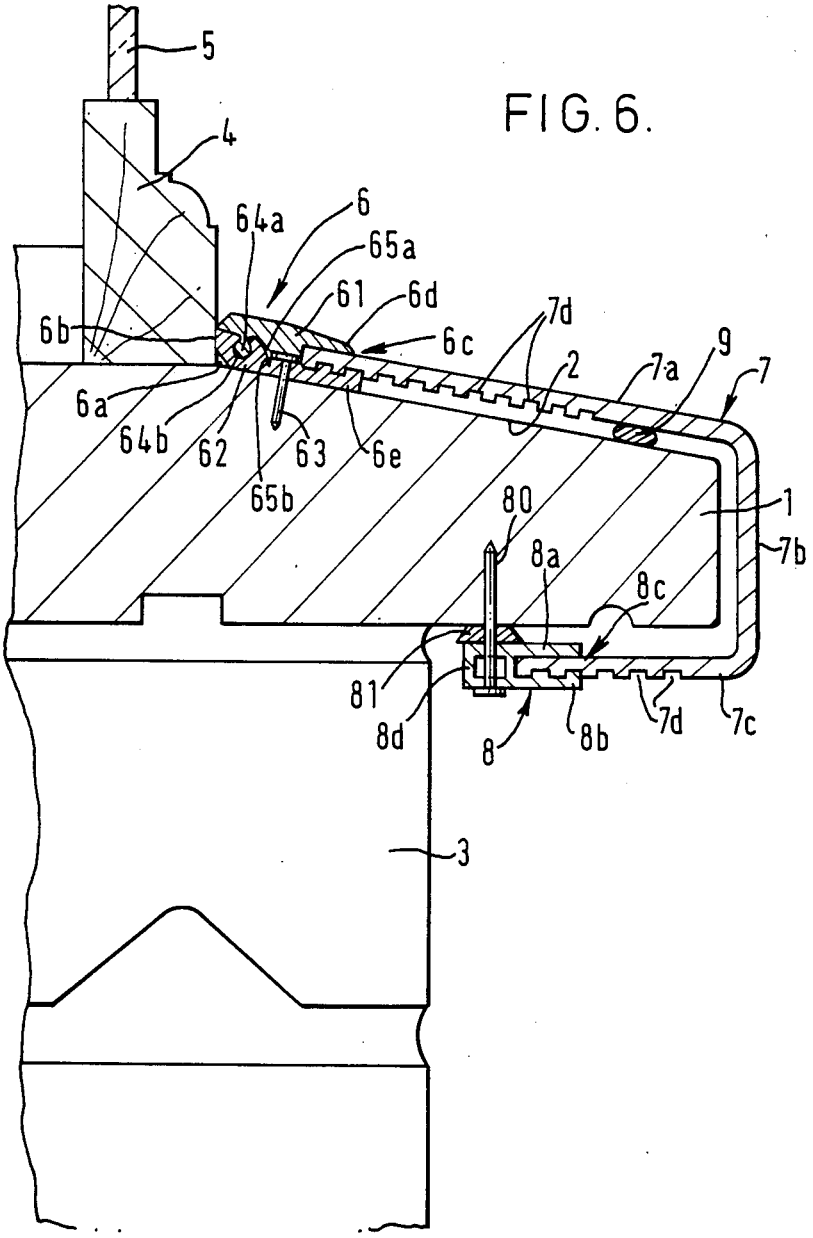
FIG. 6 is a vertical cross-section through a second protective cover embodying the invention and fitted to a typical sill.

The second form of the invention will now be described with reference to FIG. 6, in which components corresponding to those in FIG. 1 are labelled identically. Since the protective cover of FIG. 6 is very similar to that of FIG. 1 described above, only its features differing from the protective cover of FIG. 1 will be described.

The keeper strip 6 is formed by two strip components, a base strip 62, secured to the sill by aluminium securing pins 63, and a securing strip 61. The facing surfaces of the securing strip 61 and the base strip 62 are joined remotely from the recess 6*c* by an interlocking, complementary bead and groove; the bead 64*a*, of arcuate section, projecting from the underside of the securing strip 61, and the groove 64*b*, also of arcuate section, formed in the upper side of the base strip 62 adjacent the nose 6*b* which abuts against the window frame 4. The securing strip 61 and base strip 62 have cross-sections which do not vary along their length. The joint between the securing strip 61 and base strip 62 is watertight, the seal being improved by the provision of a further, wedge-shaped flange 65*a* projecting from the underside of the securing strip 61 and received in a complementary V-shaped groove 65*b* in the base strip 62.

The wedge-shaped portion of the base strip 62 lying between the arcuate groove 64*b* and the V-shaped groove 65*b* is resiliently deformable to allow the mouth of the arcuate groove 64*b* to open sufficiently to receive the bead 64*a* of the securing strip 61 with a snap action. This allows the two strips 61, 62 to be force-fitted together by forcing the bead 64*a* into the arcuate groove 64*b* in a transverse direction. Alternatively, the securing strip 61 may be fitted by sliding it along the base strip from one end.

The side of the securing strip which faces the window frame has an inclined surface. A narrow gap is provided between the opposed faces of the base strip 62 and securing strip 61 intermediate the groove 65*b* and the recess 6*c* to accommodate the heads of the securing pins 63. A lip 6*d*, whose thickness decreases towards its outer edge, and an outer portion 6*e* of the base strip, define the recess 6*c*.

The lower wall 7*c* of the cover member 7 has its detents 7*d* formed in its underside, which mate with corresponding projecting strips on the upper face of the lower wall 8*b* of the anchor strip 8.

The preferred method of assembly is to push fit the cover member 7 over the base strip 62 before fitting the securing strip 61 into interlocking engagement with the base strip 62, simultaneously trapping the free edge portion 7*d* of the cover member. The natural resilience of the cover member allows the slight angular separation of the upper and lower walls of the cover member necessary to fit it over the sill and into the keeper and anchor strips, so that the cover member is held in place during assembly even without the securing strip 61. The necessary degree of resilient deformation of the securing strip, due to the presence of the cover member, is likely to inhibit its sliding movement along the base strip, and accordingly the securing strip is best fitted by forcing the bead 64*a* into the groove 64*b* with a snap action.

An alternative method would be to fit the securing strip 61 first, and then to push fit the cover member 7 into the keeper strip 6. The bead and groove interlocking joint between the base strip 62 and securing strip 61 is such that, during assembly, the securing strip is slideable along the base strip, as indicated above, but that, upon insertion of the cover member free edge portion, the interlocking joint is made rigid and watertight by the lever action caused by the enforced separation of the opposed lips 6*d*, 6*e* of the securing strip and base strip.

The anchor strip 8 comprises a closed channel 8*d* with a rectangular section, from upper and lower walls of which extend the upper wall 8*a* and lower wall 8*b* which define the recess 8*c* receiving the cover member 7. The upper face of the lower wall 8*b* has parallel projecting strips which complement the detent 7*d* in the cover member 7 to retain it. The anchor strip 8 is secured to the underside of the sill 1 by securing pins 80 driven vertically through the centre of the closed channel 8*d* and through spacer pads 81 of appropriate thicknesses.

Silicone sealant may be applied between the inclined faces of the base stip 62 and securing strip 61 and the window frame 4, and between the lip 6*d* of the securing strip 61 and the cover member 7.

The end caps and mitre joints described above may equally well be used in the protective cover of FIG. 6.

Whilst the invention has been described with reference to particular characteristics of the embodiments described, many modifications and variations thereof are possible within the scope of the invention. The anchor strip, for example, could be assembled from two interlocking components.

I claim:

1. A protective cover for a window sill comprising:

an elongate keeper strip member fixedly mountable along and on or immediately adjacent an upper surface of the sill where the upper surface meets a superposed structural member;

an elongate anchor strip member fixedly mountable against or immediately adjacent an undersurface of the sill where the undersurface meets a subjacent structure, the keeper strip member and the anchor strip member each including a recess along the length thereof which, in use, faces forwardly of the sill;

an elongate cover member having upper, front, and lower walls shaped so as to embrace the exposed portion of the sill, said upper and lower walls having respective free edge portions; and detent means formed on said free edge portions of said upper and lower walls for maintaining said free edge portions in engagement with said keeper strip member and said anchor strip member, respectively.

2. A protective cover in accordance with claim 1, wherein the free edge portions of the upper and lower walls of the cover member are securely connectable respectively to the keeper and anchor strip members by a push fit in a direction substantially perpendicular to the front wall of the cover member.

3. A protective cover in accordance with claim 1, wherein the keeper strip and anchor strip members comprise detent means cooperable with the free edges of the upper and lower walls of the cover member to assist in maintaining the cover member in engagement with the strip members.

4. A protective cover in accordance with claim 1, wherein the said detent means comprise ribs, tenons, or serrations extending unbroken along the length of each free edge portion.

5. A protective cover in accordance with claim 1, wherein the keeper strip member is provided with an undercut face for presentation towards the superposed structural member so as to provide a nose which can readily be pressed into watertight engagement with the structural member.

6. A protective cover in accordance with claim 1, wherein the recess of the keeper strip is defined between upper and lower lips, of which at least one lip reduces in cross-section forwardly, so as to be more flexible and so as to merge smoothly with the surface of the upper wall of the cover member.

7. A protective cover in accordance with claim 1, wherein the keeper strip, the anchor strip and the cover member all have cross-sections which do not vary along their length.

8. A protective cover in accordance with claim 1, wherein the keeper strip member comprises two interlockable strip components, both having a cross-section which does not vary along their length, opposed edge portions of the two strip components defining a recess for receiving the free edge portion of the upper wall of the cover member with a push fit.

9. A protective cover in accordance with claim 1, further comprising a joint member having upper, front and lower limbs at each of side of which are provided respective recesses into which are push-fittable the free end edges of two adjacent cover members, in accordance with claim 1, disposed end to end.

10. A protective cover in accordance with claim 9, wherein the joint member is in the form of a mitre joint in which the recesses of the front limb of the joint lie at a predetermined angle corresponding to a desired mitre angle.

11. A bay window comprising a bay window sill and superposed window frames, the bay window sill comprising at least two angled sills and fitted with corresponding protective covers, each in accordance with claim 1, and joined by a joint member having upper, front and lower limbs at each of side of which are provided respective recesses into which are push-fittable the free end edges of the adjacent cover members.

12. A protective cover in accordance with claim 1, wherein the keeper and anchor strip members and the cover member are of a hard, flexible plastics material.

13. A protective cover for a window sill comprising:

an elongate keeper strip member fixedly mountable along and on or immediately adjacent an upper surface of the sill where the upper surface meets a superposed structural member;

an elongate anchor strip member fixedly mountable against or immediately adjacent an undersurface of the sill where the undersurface meets a subjacent structure, said keeper strip member and said anchor strip member each including a recess along the length thereof which, in use, faces forwardly of the sill;

an elongate cover member having upper, front, and lower walls shaped so as to embrace the exposed portion of the sill, said upper and lower walls having respective free edge portions; and detent means formed on said free edge portions of said upper and lower walls for maintaining said free edge portions in engagement with said keeper strip member and said anchor strip member, respectively, said detent means being provided over a substantial portion of the back-to-front dimension of said upper and lower walls of said cover member so that said upper and lower walls may be cut down to enable a single manufactured size of cover member to be fitted to sills having widely different extends of projection from the building structure in which they are incorporated.

14. A window comprising a window sill and a superposed window frame, the sill fitted with a protective cover comprising:

an elongate keeper strip member fixedly mounted along and on or immediately adjacent an upper surface of the sill where the upper surface meets the superposed window frame;

an elongate anchor strip member fixedly mounted against or immediately adjacent an under surface of the sill where the undersurface meets a subjacent structure, said keeper strip member and said anchor strip member each including a recess along the length thereof which faces forwardly of the sill;

an elongate cover member having upper, front, and lower walls shaped to embrace the exposed portion of the sill, the upper and lower walls having respective free edge portions; and detent means formed on said free edge portions of said upper and lower walls means for maintaining said free edge portions in engagement with said keeper strip member and said anchor strip member, respectively.

15. A method of applying a protective cover to a window sill, comprising:

securing an elongate keeper strip member along and on or immediately adjacent an upper surface of the sill where the upper surface meets a superposed structural member;

securing an elongate anchor strip member against or immediately adjacent an undersurface of the sill where the undersurface meets a subjacent structure, said keeper strip member and said anchor strip member each including a recess along the length thereof which faces forwardly of the sill;

providing an elongate cover member having upper, front and lower walls shaped to embrace the exposed portion of the sill, said upper and lower walls having respective free edge portions with detent means formed thereon; and fitting the cover member over the sill by permanently engaging said free edge portions of said upper and lower walls with said recess of said keeper strip member and said recess of said anchor strip member, respectively, said detent means enhancing the grip exerted on said free edge portions by said keeper and anchor strip members.

16. A method of applying a protective cover to a window sill, comprising:

securing an elongate keeper strip member along and on or immediately adjacent an upper surface of the sill where the upper surface meets a superposed structural member;

securing an elongate anchor strip member against or immediately adjacent an undersurface of the sill where the undersurface meets a subjacent structure, said keeper strip member and said anchor strip member each including a recess along the length thereof which faces forwardly of the sill;

providing an elongate cover member having upper, front and lower walls shaped to embrace the exposed portion of the sill, the upper and lower walls having respective free edge portions with detent means formed thereon; and fitting the cover member over the sill by permanently engaging said free edge portions of said upper and lower walls with said recess of said keeper strip member and said recess of said anchor strip member, respectively, said detent means being provided over a substantial portion of the back-to-front dimension of said upper and lower walls of said cover member, the method further comprising the step of cutting at least one said upper and lower walls to a size corresponding to the dimensions of the sill.

17. A method in accordance with claim 15 wherein, said step of fitting the cover member over the sill comprises push fitting said free edge portions in a direction substantially perpendicular to said front wall of said cover member.

* * * * *